US011759850B2

(12) United States Patent
Merrill et al.

(10) Patent No.: US 11,759,850 B2
(45) Date of Patent: Sep. 19, 2023

(54) MANUFACTURING ALIGNED COOLING FEATURES IN A CORE FOR CASTING

(71) Applicant: Siemens Energy Global GmbH & Co. KG, Munich (DE)

(72) Inventors: Gary B. Merrill, Orlando, FL (US); Jose L. Rodriguez, Longwood, FL (US); Ian T. Doran, Charlottesville, VA (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 197 days.

(21) Appl. No.: 17/594,725

(22) PCT Filed: May 22, 2019

(86) PCT No.: PCT/US2019/033504
§ 371 (c)(1),
(2) Date: Oct. 27, 2021

(87) PCT Pub. No.: WO2020/236168
PCT Pub. Date: Nov. 26, 2020

(65) Prior Publication Data

US 2022/0193758 A1 Jun. 23, 2022

(51) Int. Cl.
*B22C 13/12* (2006.01)
*B22C 9/04* (2006.01)
(Continued)

(52) U.S. Cl.
CPC ..... *B22C 13/12* (2013.01); *B22C 9/04* (2013.01); *B22C 9/065* (2013.01); *B22C 9/10* (2013.01);
(Continued)

(58) Field of Classification Search
CPC ..... B22C 9/04; B22C 9/065; B22C 13/08; F01D 5/187; F01D 5/186; F01D 5/18; F05D 2230/21; F05D 2260/202; F05D 2260/201
See application file for complete search history.

(56) References Cited

U.S. PATENT DOCUMENTS 5,533,864 A 7/1996 Nomoto et al.
6,890,153 B2 * 5/2005 Demers ..... F01D 5/186 415/115
(Continued)

FOREIGN PATENT DOCUMENTS

FR 2874187 A1 2/2006
GB 2465181 A 5/2010

OTHER PUBLICATIONS

PCT International Search Report and Written Opinion of International Searching Authority dated Jul. 24, 2019 corresponding to PCT International Application No. PCT/US2019/033504 filed May 22, 2019.

*Primary Examiner* — Eldon T Brockman
*Assistant Examiner* — Andrew Thanh Bui

(57) ABSTRACT

A molding tool (10) for manufacturing cooling features in a ceramic core for a casting process includes a first mold portion (12) comprising a crossover hole forming feature (18); a second mold portion (24) comprising an impingement jet receiving forming feature (30) for forming an impingement jet receiving feature having a desired aiming point (32); and a sacrificial alignment member (34) for extending at least partially into the crossover hole forming feature (18) at least partially into the aiming point (32) of the impingement jet receiving forming feature (30) for substantially aligning a central axis (38) of the crossover hole forming feature (18) with the aiming point (32) to maintain
(Continued)

a crossover hole and aiming point alignment during casting to ensure that the jet is directed at the aiming point (32) in a resultant cast part.

17 Claims, 2 Drawing Sheets

(51) Int. Cl.

| | |
|---|---|
| ***B22C 9/06*** | (2006.01) |
| ***B22C 9/10*** | (2006.01) |
| ***B22C 13/08*** | (2006.01) |
| ***F01D 5/18*** | (2006.01) |

(52) U.S. Cl.
CPC ..... *B22C 13/08* (2013.01); *F01D 5/187* (2013.01); *F05D 2230/21* (2013.01)

(56) References Cited

U.S. PATENT DOCUMENTS

| | | | | |
|---|---|---|---|---|
| 7,625,180 | B1 | 12/2009 | Liang | |
| 8,757,974 | B2 * | 6/2014 | Propheter-Hinckley | F01D 5/188 416/97 R |
| 10,352,177 | B2 * | 7/2019 | Bunker | F01D 5/147 |
| 2008/0273963 | A1 | 11/2008 | Spangler et al. | |
| 2015/0122445 | A1 | 5/2015 | Truelle et al. | |

* cited by examiner

MANUFACTURING ALIGNED COOLING FEATURES IN A CORE FOR CASTING

BACKGROUND

1. Field

The present invention relates to a method of manufacturing advanced features in a core for casting.

2. Description of the Related Art

Typically, gas turbine engines include a compressor for compressing air, a combustor for mixing the compressed air with fuel and igniting the mixture, and turbine airfoils for producing power. Combustors often operate at high temperatures that may exceed 2,500 degrees Fahrenheit. Typical turbine combustor configurations expose turbine airfoils to these high temperatures. As a result, turbine airfoils and must be made of materials capable of withstanding such high temperatures. Typically, thermal barrier coatings (TBC's) are applied to exterior surfaces of the airfoils to protect them from exposure to high temperatures, but such coating may be subject to spallation over time, especially on the airfoil leading edges.

In addition, turbine blades often contain cooling systems for prolonging the life of the airfoils and reducing the likelihood of failure as a result of excessive temperatures. Internal cooling systems often include a plurality of impingement orifices positioned in a wall. The wall with the impingement orifices is typically positioned in close proximity to another wall surface, whereby the cooling fluid flowing through the impingement orifices form impingement jets that are directed into contact with the wall surface. As such, the impingement jet of cooling fluids impinge on the wall surface, which increases the cooling efficiency of the cooling system.

Forming ceramic cores require first producing a consumable preform or internal mold geometry. A wax preform is then placed into a mold and ceramic slurry is injected around the preform. The ceramic slurry is dried to a green state and then removed from the mold and placed into a furnace for firing of the green body to form the ceramic core. Ceramic molds are often difficult to produce and subject to distortion, breakage and low yields because the green body strength of the dried but unfired ceramic slurry is low, and it remains unsupported on its interior surface once the wax preform melts.

SUMMARY

In an aspect of the present invention, a molding tool for manufacturing cooling features in a ceramic core for a casting process includes a first mold portion comprising a cooling fluid receiving side and cooling fluid jetting side, the first mold portion comprising at least one crossover hole forming feature for forming a crossover hole having a cooling fluid inlet at the cooling fluid receiving side for receiving at least a portion of a cooling fluid and discharging a directed jet of the at least portion of the cooling fluid from a cooling fluid outlet at the cooling fluid jetting side. The molding tool further includes a second mold portion spaced away from the first mold portion and comprising a jetted fluid receiving side facing the cooling fluid jetting side of the first mold portion and an impingement cooled surface side; wherein the second mold portion comprising an impingement jet receiving forming feature for forming an impingement jet receiving feature extending away from the jetted fluid receiving side of the second mold portion, the impingement jet receiving feature comprising a desired aiming point for receiving a majority portion of the directed jet thereon so as to improve cooling performance. The molding tool further includes a sacrificial alignment member for extending at least partially into the crossover hole forming feature at the cooling fluid jetting side into a space between the first mold portion and the second mold portion and extending at least partially into the aiming point of the impingement jet receiving forming feature for substantially aligning a central axis of the crossover hole forming feature with the aiming point to maintain a crossover hole and aiming point alignment during casting to ensure that the jet is directed at the aiming point in a resultant cast part.

In another aspect of the present invention, a method for manufacturing cooling features in a ceramic core for a casting process includes providing a first mold portion comprising a cooling fluid receiving side and cooling fluid jetting side, the first mold portion comprising at least one crossover hole forming feature for forming a crossover hole having a cooling fluid inlet at the cooling fluid receiving side for receiving at least a portion of a cooling fluid and discharging a directed jet of the at least portion of the cooling fluid from a cooling fluid outlet at the cooling fluid jetting side providing a second mold portion spaced away from the first mold portion and comprising a jetted fluid receiving side facing the cooling fluid jetting side of the first mold portion and an impingement cooled surface side; wherein the second mold portion comprises an impingement jet receiving forming feature for forming an impingement jet receiving feature extending away from the jetted fluid receiving side of the second mold portion, the impingement jet receiving feature comprising a desired aiming point for receiving a majority portion of the directed jet thereon so as to improve cooling performance. The method further includes inserting a sacrificial alignment member at least partially into the crossover hole forming feature at the cooling fluid jetting side into a space between the first mold portion and the second mold portion and extending at least partially into the aiming point of the impingement jet receiving forming feature for substantially aligning a central axis of the crossover hole forming feature with the aiming point to maintain a crossover hole and aiming point alignment during casting to ensure that the jet is directed at the aiming point in a resultant cast part and using the first and second mold portions aligned by the sacrificial member in an investment casting process to manufacture a cast part.

In another aspect of the present invention, an impingement cooling system for a gas turbine engine component includes a coolant cavity positioned within the gas turbine engine component receiving a flow of a cooling fluid, an impingement cavity positioned within the gas turbine engine component comprising an impingement cooled surface side, for exposure to a hot gas flow; an impingement jet wall separating the cooling cavity from the impingement cavity, the impingement jet wall comprising at least one a crossover hole having a cooling fluid inlet at a cooling fluid receiving side for receiving at least a portion of a cooling fluid and discharging a directed jet of the at least portion of the cooling fluid from a cooling fluid outlet at a cooling fluid jetting side and further comprising an impingement jet conditioning feature at the cooling fluid jetting side for conditioning the flow of the directed jet therefrom. The cooling system further includes an exterior wall spaced away from the impingement jet wall to define the impingement cavity therebetween, the exterior wall comprising a jetted fluid receiving side facing the cooling fluid jetting side of the impingement jet wall and the impingement cooled surface side and further comprising an impingement jet receiving feature extending away from the jetted fluid receiving side, where the impingement jet receiving feature comprises an aiming point for receiving a majority portion of the directed jet thereon so as to enhance a cooling of the exterior wall wherein a central axis of the crossover hole is substantially aligned with the aiming point to ensure that the directed jet is directed at the aiming point for increasing a cooling effectiveness of the impingement jet receiving feature.

BRIEF DESCRIPTION OF THE DRAWINGS

The invention is shown in more detail by help of figures. The figures show preferred configurations and do not limit the scope of the invention.

DETAILED DESCRIPTION

Figure 1:
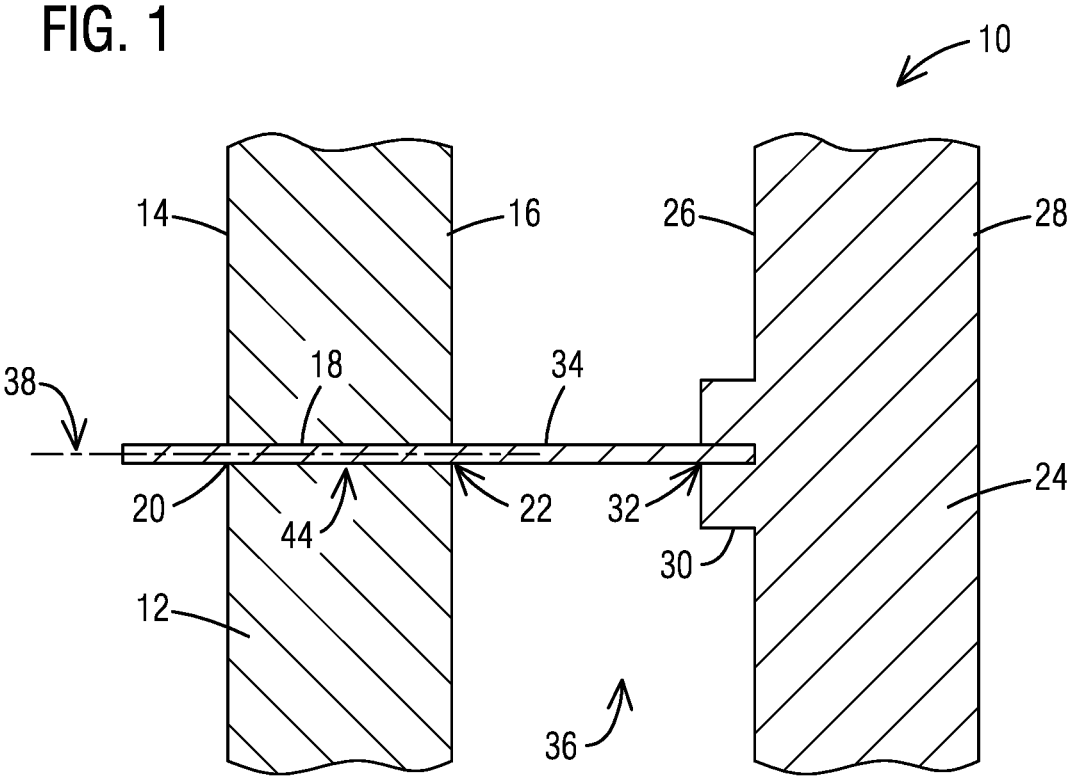
FIG. 1 is a partial side view of a molding tool taken along a mold split line according to an exemplary embodiment of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Gas turbine airfoil TBC degradation and spallation is most prevalent on the leading edges of the airfoils. Cooling fluid impingement jets directed at the backside of the leading edge from a serpentine cooling passage are commonly used to cool the leading edge, consequently improving the life and spallation resistance of the airfoil.

In addition, impingement features formed on the backside of hot gas path components, such as described in US published patent application 20180258773 and PCT published patent application WO2018044266A1, can increase the impingement cooling efficiency. The inventors of the present invention have innovatively recognized that the cooling performance of the impingement features can be significantly improved by focusing an impingement jet on a certain portion of the impingement feature relative to an unfocused jet. However, conventional casting of such focused jets and maintaining relative alignment of the jets with certain areas of impingement features during in an investment casting process can be difficult to achieve.

Broadly, an embodiment of the present invention includes an investment casting tool having a first mold portion with a coolant jet forming feature and a second mold portion with an impingement cooling forming feature. The tool further includes an insertable sacrificial alignment member to align and maintain alignment of the two forming features to ensure that the portions are aligned relative to each other when casting to provide optimum impingement cooling of the cast part.

The tool, system, and method described below may be used with a process that starts with a 3D computer model of a part to be created. From the model a solid surface may be created from which a flexible mold can be created that is used in conjunction with a second mating flexible mold to form a mold cavity. The flexible mold may be created from a machined master tool representing roughly fifty percent of the surface geometry of the core to be created. From such a tool, a flexible transfer mold can be created. To form a mold cavity, a second half of the master tool that creates a second flexible transfer mold, can be combined with the first flexible transfer mold to form the mold cavity. A curable slurry can be supplied in the mold cavity and allowed to cure to create a three-dimensional component form. An example of such a form can be a ceramic core used for investment casting.

The materials of construction of the core are specifically selected to work in cooperation with the casting and firing processes to provide a core that overcomes known problems with prior art cores. The materials and processes of the present invention result in a ceramic body which is suitable for use in a conventional metal alloy casting process.

FIG. 1 shows a partial side view of a molding tool (10) for manufacturing cooling features in a ceramic core for a casting process. The casting may be investment casting or the like. The core may be a ceramic, as will be mentioned throughout, or other materials such as powdered metals, polymers, and composites. Molds may also be ceramic or of other materials. In an example embodiment, the molding tool (10) comprises a first mold portion (12) having a cooling fluid receiving side (14) and cooling fluid jetting side (16). The first mold portion (16) includes at least one crossover hole forming feature (18) for forming a crossover hole having a cooling fluid inlet (20) at the cooling fluid receiving side (14). The cooling fluid inlet (20) is formed for receiving at least a portion of a cooling fluid and discharging a directed jet of the at least portion of the cooling fluid from a cooling fluid outlet (22) at the cooling fluid jetting side (16).

The molding tool (10) includes a second mold portion (24) spaced away from the first mold portion (12). The second mold portion (24) includes a jetted fluid receiving side (26) facing the cooling fluid jetting side (16) of the first mold portion (12) and an impingement cooled surface side (28). The second mold portion (24) further includes an impingement jet receiving forming feature (30) for forming an impingement jet receiving feature extending away from the jetted fluid receiving side (26) of the second mold portion (24). In an example embodiment, the impingement jet receiving feature comprises a desired aiming point (32) for receiving a majority portion of the directed jet thereon so as to improve cooling performance. Although FIG. 1 shows the crossover hole forming feature (18) and impingement jet receiving forming feature (30) being oriented in a vertical configuration, their positions are not limited to a vertical orientation, and could be oriented horizontally or at a desired angle relative to an orientation of the component.

Figure 2:
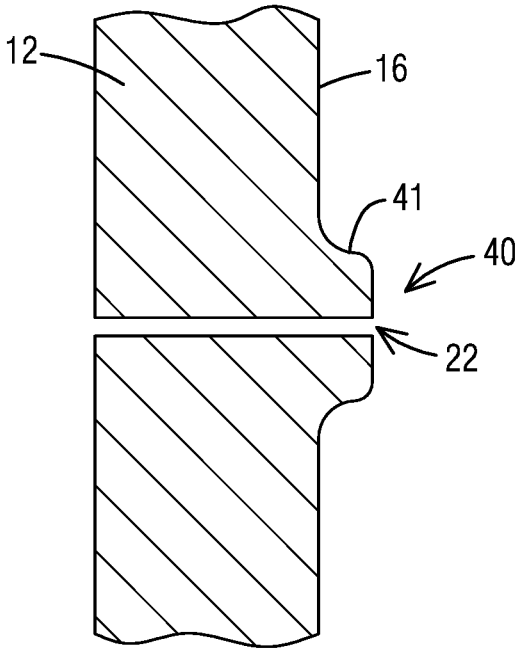
FIG. 2 is a partial side view of a first mold portion of the molding tool of FIG. 1 showing an exemplary embodiment of the present invention.
Figure 3:
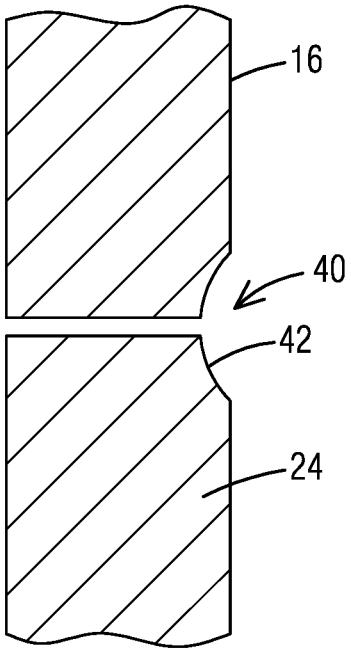
FIG. 3 is a partial side view of a first mold portion of the molding tool of FIG. 1 showing an exemplary embodiment of the present invention.

In an example embodiment, the molding tool of claim 1 further comprises an impingement jet forming feature (40) positioned at the cooling fluid outlet (22) for forming an impingement jet feature for conditioning the flow of the at least portion of the cooling fluid therefrom. For example, as shown in FIG. 2, the impingement jet forming feature (40) may include a nozzle forming feature for forming a nozzle extending away from the cooling fluid jetting side (16) into the space (36). In an example embodiment, the impingement jet forming feature (40) may take the form of a protrusion extending from an otherwise flat surface of the cooling fluid jetting side (16). In another example shown in FIG. 3, the impingement jet forming feature (40) may include a recess forming feature (42) for forming a recess extending into the cooling fluid jetting side (16). In an exemplary embodiment, the recess forming feature (42) may include a dimple or a truncated dimple. The impingement jet forming feature (40) may be geometrically configured and sized to impart a desired jet flow characteristic, such as desired radiation pattern or an angular direction away from the cooling fluid jetting side (16).

In another aspect of the inventions, the molding tool (10) further includes a fugitive, or sacrificial, alignment member (34) for extending at least partially into the crossover hole forming feature (18) at the cooling fluid jetting side (16) into the space (36) between the first mold portion (12) and the second mold portion (24) and extending at least partially into the aiming point (32) of the impingement jet receiving forming feature (30). The alignment member (34) aligns a central axis (38) of the crossover hole forming feature (18) with the aiming point (32) to maintain a crossover hole and aiming point alignment during casting to ensure that the jet is directed at the aiming point (32) in a resultant cast part.

In an example embodiment, the sacrificial alignment member (34) is a cylindrical rod that may be inserted through the crossover hole forming feature (18), across the space (36) and into the aiming point (32) to keep the crossover hole forming feature (18) and the impingement jet forming feature (40) aligned. In another example, the sacrificial alignment member (34) may include a fluid flow forming portion (44) shaped to form a desired geometrical configuration of the crossover hole for conditioning the flow of the at least portion of the of cooling fluid therethrough. For example, the fluid forming portion (44) may include a circular, oval, or elongated oval cross section, but any geometrical cross section as would be appreciated by one skilled in the art could be used to condition the flow in a desired manner. In an example embodiment, the sacrificial alignment member comprises a material, such as a ceramic material, that is fugitive in an investment casting process. For example, the material needs to be selected to have a sufficiently high melting temperature exceeding a melting temperature of a subsequently poured or injected liquid state metal into the mold, yet is cable of being removed, such as by chemical leaching, after the metal has cooled and hardened.

In an aspect of the invention, the split line, or parting line of the mold may be offset to provide an angular path of the directed jet offset from a centerline of the mold to allow the impingement jet receiving feature to be offset from the centerline of the mold.

A method for manufacturing cooling features in a ceramic core for a casting process may include providing a first mold portion (12) having a cooling fluid receiving side (14) and cooling fluid jetting side (16). The first mold portion (16) may include at least one crossover hole forming feature (18) for forming a crossover hole having a cooling fluid inlet (20) at the cooling fluid receiving side (14) for receiving at least a portion of a cooling fluid and discharging a directed jet of the at least portion of the cooling fluid from a cooling fluid outlet (22) at the cooling fluid jetting side (16).

The method may further include providing a second mold portion (24) spaced away from the first mold portion (12) wherein second mold portion (24) comprises a jetted fluid receiving side (26) facing the cooling fluid jetting side (16) of the first mold portion (12) and an impingement cooled surface side (28). The second mold portion (24) includes an impingement jet receiving forming feature (30) for forming an impingement jet receiving feature extending away from the jetted fluid receiving side (26) of the second mold portion (24). The impingement jet receiving feature includes a desired aiming point (32) for receiving a majority portion of the directed jet thereon so as to improve cooling performance.

The method further includes inserting a sacrificial alignment member (34) at least partially into the crossover hole forming feature (18) at the cooling fluid jetting side (16) into a space (36) between the first mold portion (12) and the second mold portion (24) and extending at least partially into the aiming point (32) of the impingement jet receiving forming feature (30) for substantially aligning a central axis (38) of the crossover hole forming feature (18) with the aiming point (32) to maintain a crossover hole and aiming point alignment during casting to ensure that the jet is directed at the aiming point (32) in a resultant cast part. The method may further include using the first and second mold portions (12, 24) aligned by the sacrificial member (34) in an investment casting process to manufacture the cast part.

In an exemplary embodiment, the method may further include allowing the sacrificial member (34) to be fugitively removed in a subsequent step of the investment casting process. In an aspect of the invention, the member (34) may be chemically leached out of the casting.

Figure 4:
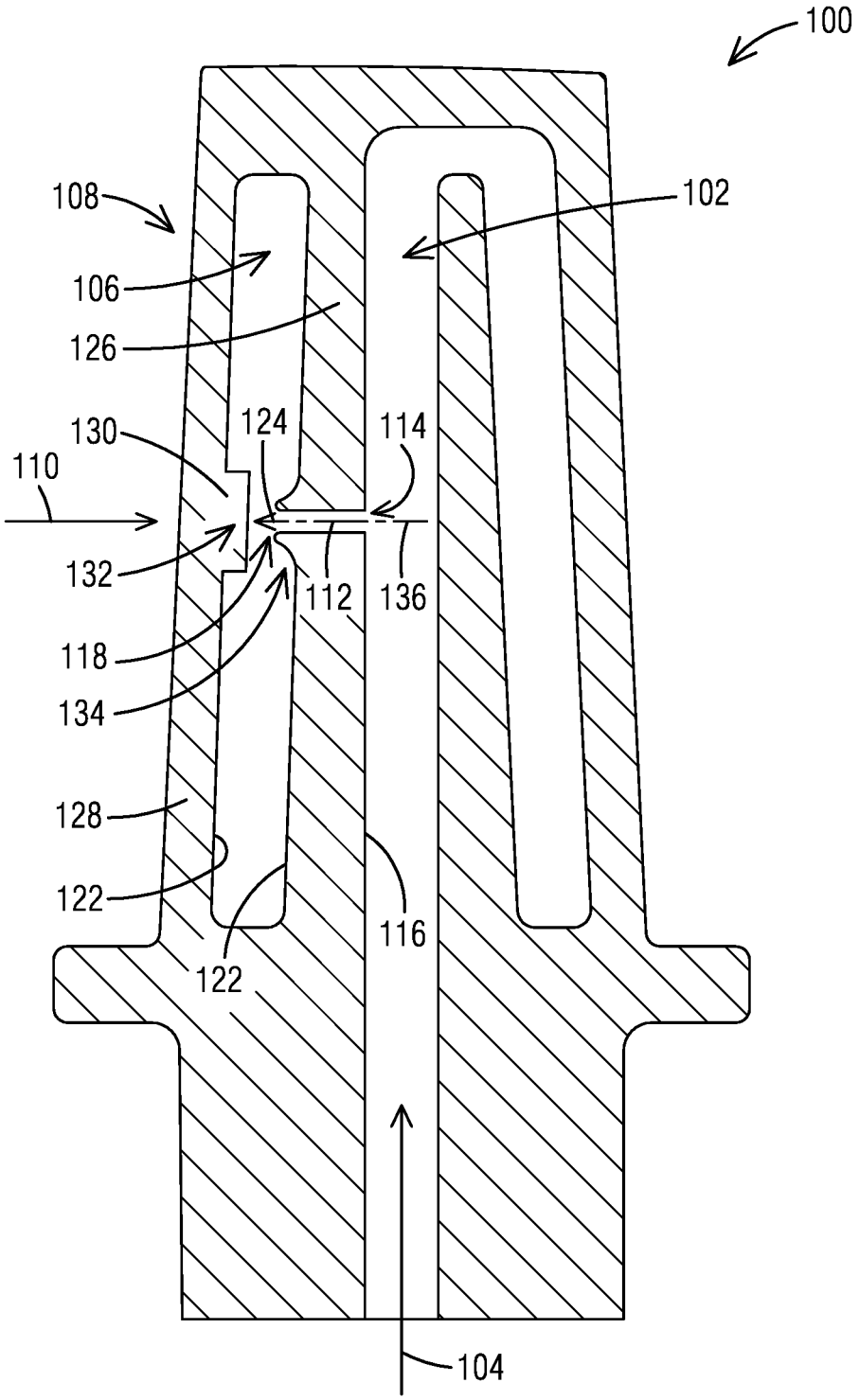
FIG. 4 is a cutaway side view of an impingement cooling system for a gas turbine engine component according to an exemplary embodiment of the present invention.

In another aspect of the invention shown in FIG. 4, an impingement cooling system for a gas turbine engine component (100) includes a coolant cavity (102) positioned within the gas turbine engine component (100) receiving a flow of a cooling fluid (104) and an impingement cavity (106) positioned within the gas turbine engine component (100) comprising an impingement cooled surface side (108) for exposure to a hot gas flow (110).

In an aspect of the invention, an impingement jet wall (126) separates the cooling cavity (102) from the impingement cavity (106). The impingement jet wall (112) comprises at least one a crossover hole (112) having a cooling fluid inlet (114) at a cooling fluid receiving side (116) for receiving at least a portion of a cooling fluid (104) and discharging a directed jet (124) of the at least portion of the cooling fluid (104) from a cooling fluid outlet (118) at a cooling fluid jetting side (120). The impingement jet wall (112) may further comprise an impingement jet conditioning feature (134) at the cooling fluid jetting side (120) for conditioning the flow of the directed jet (124) therefrom. In exemplary embodiments, the impingement jet conditioning feature (134) may include a nozzle extending away from the cooling fluid jetting side (120) into the space (106) or a recess extending into the cooling fluid jetting side (120). The nozzle or recess may be geometrically configured and sized to impart a desired jet flow characteristic, such as desired radiation pattern or angular direction away from the cooling fluid jetting side (120).

The system may further include an exterior wall (128) spaced away from the impingement jet wall (126) to define the impingement cavity (106) therebetween. The exterior wall (128) may include a jetted fluid receiving side (122) facing the cooling fluid jetting side (120) of the impingement jet wall (126) and the impingement cooled surface side (108). The system may further include an impingement jet receiving feature (130) extending away from the jetted fluid receiving side (122), where the impingement jet receiving feature (130) comprises an aiming point (132) for receiving a majority portion of the directed jet (124) thereon to enhance a cooling of the exterior wall (128). In an exemplary aspect of the invention, a central axis (136) of the crossover hole (112) is substantially aligned with the aiming point (132) to ensure that the directed jet (124) is directed at the aiming point (32) for increasing a cooling effectiveness of the impingement jet receiving feature (130).

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof

What is claimed is:

1. A molding tool (10) for manufacturing cooling features in a ceramic core for a casting process comprising:

a first mold portion (12) comprising a cooling fluid receiving side (14) and cooling fluid jetting side (16), the first mold portion (16) comprising at least one crossover hole forming feature (18) for forming a crossover hole having a cooling fluid inlet (20) at the cooling fluid receiving side (14) for receiving at least a portion of a cooling fluid and discharging a directed jet of the at least portion of the cooling fluid from a cooling fluid outlet (22) at the cooling fluid jetting side (16);

a second mold portion (24) spaced away from the first mold portion (12) and comprising a jetted fluid receiving side (26) facing the cooling fluid jetting side (16) of the first mold portion (12) and an impingement cooled surface side (28);

the second mold portion (24) comprising an impingement jet receiving forming feature (30) for forming an impingement jet receiving feature extending away from the jetted fluid receiving side (26) of the second mold portion (24), the impingement jet receiving feature comprising a desired aiming point (32) for receiving a majority portion of the directed jet thereon so as to improve cooling performance; and a sacrificial alignment member (34) for extending at least partially into the crossover hole forming feature (18) at the cooling fluid jetting side (16) into a space (36) between the first mold portion (12) and the second mold portion (24) and extending at least partially into the aiming point (32) of the impingement jet receiving forming feature (30) for substantially aligning a central axis (38) of the crossover hole forming feature (18) with the aiming point (32) to maintain a crossover hole and aiming point alignment during casting to ensure that the jet is directed at the aiming point (32) in a resultant cast part.

2. The molding tool of claim 1, further comprising an impingement jet forming feature (40) positioned at the cooling fluid outlet (22) for forming an impingement jet feature for conditioning the flow of the at least portion of the cooling fluid therefrom.

3. The molding tool of claim 2, wherein the impingement jet forming feature (40) comprises a nozzle forming feature (41) for forming a nozzle extending away from the cooling fluid jetting side (16) into the space (36).

4. The molding tool of claim 2, wherein the impingement jet forming feature (40) comprises a recess forming feature (42) for forming a recess extending into the cooling fluid jetting side (16).

5. The molding tool of claim 4, wherein the recess forming feature (42) comprises a dimple or a truncated dimple.

6. The molding tool of claim 1, wherein the sacrificial alignment member (34) comprises a cylindrical rod.

7. The molding tool of claim 1, wherein the sacrificial alignment member (34) comprises a fluid flow forming portion (44) shaped to form a desired geometrical configuration of the crossover hole for conditioning the flow of the at least portion of the of cooling fluid therethrough.

8. The molding tool of claim 7, wherein the fluid flow forming portion (44) comprises a circular, oval, or elongated oval cross section.

9. The molding tool of claim 1, wherein the sacrificial alignment member comprises a ceramic material.

10. The molding tool of claim 1, where the parting line of the mold is offset to provide an angular path of the directed jet offset from a centerline of the mold to allow the impingement jet receiving feature to be offset from the centerline of the mold.

11. A method for manufacturing cooling features in a ceramic core for a casting process comprising:

providing a first mold portion (12) comprising a cooling fluid receiving side (14) and cooling fluid jetting side (16), the first mold portion (16) comprising at least one crossover hole forming feature (18) for forming a crossover hole having a cooling fluid inlet (20) at the cooling fluid receiving side (14) for receiving at least a portion of a cooling fluid and discharging a directed jet of the at least portion of the cooling fluid from a cooling fluid outlet (22) at the cooling fluid jetting side (16);

providing a second mold portion (24) spaced away from the first mold portion (12) and comprising a jetted fluid receiving side (26) facing the cooling fluid jetting side (16) of the first mold portion (12) and an impingement cooled surface side (28); wherein the second mold portion (24) comprises an impingement jet receiving forming feature (30) for forming an impingement jet receiving feature extending away from the jetted fluid receiving side (26) of the second mold portion (24), the impingement jet receiving feature comprising a desired aiming point (32) for receiving a majority portion of the directed jet thereon so as to improve cooling performance;

inserting a sacrificial alignment member (34) at least partially into the crossover hole forming feature (18) at the cooling fluid jetting side (16) into a space (36) between the first mold portion (12) and the second mold portion (24) and extending at least partially into the aiming point (32) of the impingement jet receiving forming feature (30) for substantially aligning a central axis (38) of the crossover hole forming feature (18) with the aiming point (32) to maintain a crossover hole and aiming point alignment during casting to ensure that the jet is directed at the aiming point (32) in a resultant cast part; and using the first and second mold portions (12, 24) aligned by the sacrificial member (34) in an investment casting process to manufacture a cast part.

12. The method of claim 11, further comprising allowing the sacrificial member (34) to be fugitively removed in a subsequent step of the investment casting process.

13. The method of claim 12, wherein the step of allowing the sacrificial member (34) to be fugitively removed comprises chemically leaching the member (34) out of a casting.

14. An impingement cooling system for a gas turbine engine component (100) comprising:

a coolant cavity (102) positioned within the gas turbine engine component (100) receiving a flow of a cooling fluid (104), an impingement cavity (106) positioned within the gas turbine engine component (100) comprising an impingement cooled surface side (108), for exposure to a hot gas flow (110);

an impingement jet wall (126) separating the cooling cavity (102) from the impingement cavity (106), the impingement jet wall (112) comprising at least one a crossover hole (112) having a cooling fluid inlet (114) at a cooling fluid receiving side (116) for receiving at least a portion of a cooling fluid (104) and discharging a directed jet (124) of the at least portion of the cooling fluid (104) from a cooling fluid outlet (118) at a cooling fluid jetting side (120) and further comprising an impingement jet conditioning feature (134) at the cooling fluid jetting side (120) for conditioning the flow of the directed jet (124) therefrom;

an exterior wall (128) spaced away from the impingement jet wall (126) to define the impingement cavity (106) therebetween, the exterior wall (128) comprising a jetted fluid receiving side (122) facing the cooling fluid jetting side (120) of the impingement jet wall (126) and the impingement cooled surface side (108); and further comprising an impingement jet receiving feature (130) extending away from the jetted fluid receiving side (122), where the impingement jet receiving feature (130) comprises an aiming point (132) for receiving a majority portion of the directed jet (124) thereon so as to enhance a cooling of the exterior wall (128); and wherein a central axis (136) of the crossover hole (112) is substantially aligned with the aiming point (132) to ensure that the directed jet (124) is directed at the aiming point (32) for increasing a cooling effectiveness of the impingement jet receiving feature (130).

15. The system of claim 14, wherein the impingement jet conditioning feature (134) comprises a nozzle extending away from the cooling fluid jetting side (120) into the space (106).

16. The system of claim 14, wherein the impingement jet conditioning feature (134) comprises a recess extending into the cooling fluid jetting side (120).

17. The system of claim 14, wherein the impingement jet conditioning feature (134) comprises a recess forming feature (42), and the recess forming feature (42) comprises a dimple or a truncated dimple.

* * * * *